US009095857B2

(12) United States Patent
Shih

(10) Patent No.: US 9,095,857 B2
(45) Date of Patent: Aug. 4, 2015

(54) PAINT SPRAY-GUN EVEN-PRESSURE DIVERTING HOUSING STRUCTURE

(71) Applicant: Hsien-Chao Shih, Changhua (TW)

(72) Inventor: Hsien-Chao Shih, Changhua (TW)

( * ) Notice: Subject to any disclaimer, the term of this patent is extended or adjusted under 35 U.S.C. 154(b) by 110 days.

(21) Appl. No.: 14/134,355

(22) Filed: Dec. 19, 2013

(65) Prior Publication Data

US 2015/0174597 A1 Jun. 25, 2015

(51) Int. Cl.

| | |
|---|---|
| ***F23D 11/10*** | (2006.01) |
| ***F23D 14/42*** | (2006.01) |
| ***B05B 7/08*** | (2006.01) |
| ***B05B 7/12*** | (2006.01) |

(52) U.S. Cl.

CPC ..... *B05B 7/0815* (2013.01); *B05B 7/1218* (2013.01)

(58) Field of Classification Search

CPC ..... F23D 14/04; F23D 14/42; F23D 11/10; F02M 69/047; F02M 67/12; B05B 7/12; B05B 7/1209

USPC ..... 239/407, 408, 409, 413, 414, 419, 239/419.3, 418, 290, 291, 296

See application file for complete search history.

(56) References Cited

U.S. PATENT DOCUMENTS

| | | | | |
|---|---|---|---|---|
| 6,085,996 | A * | 7/2000 | Culbertson et al. | 239/290 |
| 6,098,902 | A * | 8/2000 | Culbertson et al. | 239/290 |
| 6,471,144 | B1 * | 10/2002 | Huang | 239/296 |
| 7,163,160 | B2 * | 1/2007 | Liu | 239/296 |

* cited by examiner

*Primary Examiner* — Justin Jonaitis
*Assistant Examiner* — Christopher R Dandridge

(57) ABSTRACT

The present invention is to provide a paint spray-gun even-pressure diverting housing structure formed by an inter housing and an outer housing, and the assembly is slotted into the paint spray-gun head cavity wherein the centers of both housings are respectively installed with holes for paint spray-gun nozzle cross-assembled into a set. The inner housing and the outer housing are installed using with two independent guiding gas channels for sending spraying paint airflow and atomization airflow, and the gaps of each guiding gas channel are cross-positioned in conduction. As the inner housing and outer housing are combined the channels of the two housing maintain the crossing relationship, thereby the spitted airflow and the atomization airflow spitted present circulating stream in the two guiding gas channels in both housings delay the time staying in the nozzle cavity, further to achieve even-exiting air effect and improve painting quality.

2 Claims, 5 Drawing Sheets

PAINT SPRAY-GUN EVEN-PRESSURE DIVERTING HOUSING STRUCTURE

FIELD OF THE PRESENT INVENTION

The present invention is a paint spray-gun even-pressure diverting housing structure, mainly through the gap crossing position guiding style design of its diverting housing so that its airflow is able to circulate through and extend its time in staying in the cavity of the spray-gun head. In this way, the Spraying paint airflow and atomization airflow are spit out evenly from the spitting hole of the air outlet in the center of the spray-gun housing, and both sides of the flank section.

DESCRIPTION OF PRIOR ART

Normally the structural design of a paint spray-gun body is installed, suitable for holding in hand. At the lower side of the handle of the main body a connector is installed for connecting to the air compression device, and another knob is installed to control the inlet air volume in order to adjust the degree of paint atomization accommodating with the pressing handle installed on the upper cavity section of the handle section for the control of the trigger cross installed in the cavity section of the main body in order to control the opening of the nozzle on the front. And with the controlling knob at the back of the cavity section of the main body, the strength of the pressing force and the amplitude of the opening can be varied. Also, another adjustment knob is installed at the back of the cavity section of the main body for the control of the outlet air volume of the spray-gun housing at the front. Based on the basic functional structure of this kind of paint spray-gun, it is possible to control the opening of the nozzle through the trigger by the pressing or releasing of the handle to match with the internal airflow passing through the channel by using the air compression device to spit out the inlet air from the nozzle, and to guide the paint in the paint container to spit out while releasing the lateral air spitting from the flank sections protruding on both sides of the spray-gun housing, so that the paint is atomized evenly painted on the work object. Meanwhile, depending on the requirement of the work object and working environment the atomizing result of the paint is varied through the adjusting of the lateral spitting air volume of the spray-gun housing by the adjustment knob to further obtain the best painting operational quality.

The design of guiding the spitting airflow is mainly achieved in the design of a spitting paint hole and an atomizing air hole inside the nozzle cavity of the spray-gun, and through the two sets of independent guiding gas channels installed on the diverting housing. The paint airflow is guided by the spitting air hole through the guiding gas channel in the diverting housing internal area and is blown out from the air outlet of the center of spray-gun housing, while at the same time spitting out the guided paint to achieve the function of spreading the paint. And the atomization airflow guided by the atomizing hole is spitted out from the protruding flank sections installed on both sides of the spray-gun housing through the guiding of the guiding gas channel and the squeeze of the paint into the atomizing effect.

However, the previously described diverting action is mainly achieved through the isolation of the spraying paint airflow blown out from the spraying paint air hole and the atomization airflow spit out from the atomizing air hole so that both airflow do not interfere with each other and are guided through the planned route. Therefore, the guiding gas channels are installed in penetrating style. In this way, as the spraying paint airflow and the atomization airflow are spit out from their respective holes, they are blown out from the air outlet and spitting hole directly through the guiding gas channel of the diverting housing. Due to the missing of the even pressure design and adding that the strengths of the air pressures guided from the spray-gun might not be the same, leading the outlet air might be unstable. Hence, the spraying paint volume and the stability of atomization airflow are seriously affected, resulting in the quality of spraying paint being hard to maintain and indeed requires to be resolved and improved.

DESCRIPTION OF THE INVENTION

In view of the problems existing in the spraying operation of spray-guns to obtain an even pressure result when the spraying paint airflow and atomization airflow are guided and spit out, leading to difficulty in maintaining stability, the inventor engaged in the research of improvement. Due to many years of experience in related industry and technique, the paint spray-gun even-pressure diverting housing structure is further invented with the purpose of improving the design of structure to increase the spraying range of the atomization airflow when the paint is just sprayed out in diverting structure in order to effectively squeeze the paint to form a more even long and flat spraying style.

The other objective of the present invention is in the design of the structural plan of the diverting airflow housing that enables the paint airflow and atomization airflow of the spray-gun to go through the diverting housing in a circulating manner, thereby extending the staying time and obtaining an even pressure spitting result, making the spraying of paint more evenly distributed.

To achieve the objectives revealed above, the diverting housing of the present invention uses the composite model of the inner housing and outer housing wherein an isolation ring existed in the inner lateral face of the inner housing in order to isolate the spraying paint air hole and atomization air hole installed in the spray-gun head cavity of the spray-gun Within the radius of the isolation ring, a reserved number of guiding steam gap holes are installed, and the inlet and outlet of the guiding stream gap holes are presenting in a non-penetrating crossly located guiding style. And in the peripheral edge of the inner housing an airflow circulation tank is formed. In addition, the peripheral edge of the inner side plate of the airflow circulation tank is isolated and installed with a reserved number of inlet tanks, whereas the outer side plate of the airflow circulating tank is cross-inserted penetratingly with a reserved number of outlet holes from the position of the bottom of the tank. Also, the inner side of the outer housing forms a pair of dual isolation rings, whereas a number of reserved guiding steam air holes are installed in the circulating tank of the isolation ring, and the outer housing is compositely covered on the outside of the inner housing, and the guiding steam air hole and the exit of the guiding steam gap hole of the inner housing form a crossing relationship. The outer peripheral of the outer housing also forms an airflow circulation tank. The peripheral edge of the inner plate of the airflow circulating tank is installed with a reserved number of inlet tanks in isolated style while at the cross inserted position of the inlet tank of the outer side plate of the airflow circulating tank is installed with a reserved number of outlet gas holes. With such airflow guiding holes planned by the airflow guiding structure of inner housing and outer housing, the spraying paint airflow and the atomization airflow of the paint spray-gun is presenting circulating flow and achieves outlet air effect in order to increase its paint quality.

Figure 1:
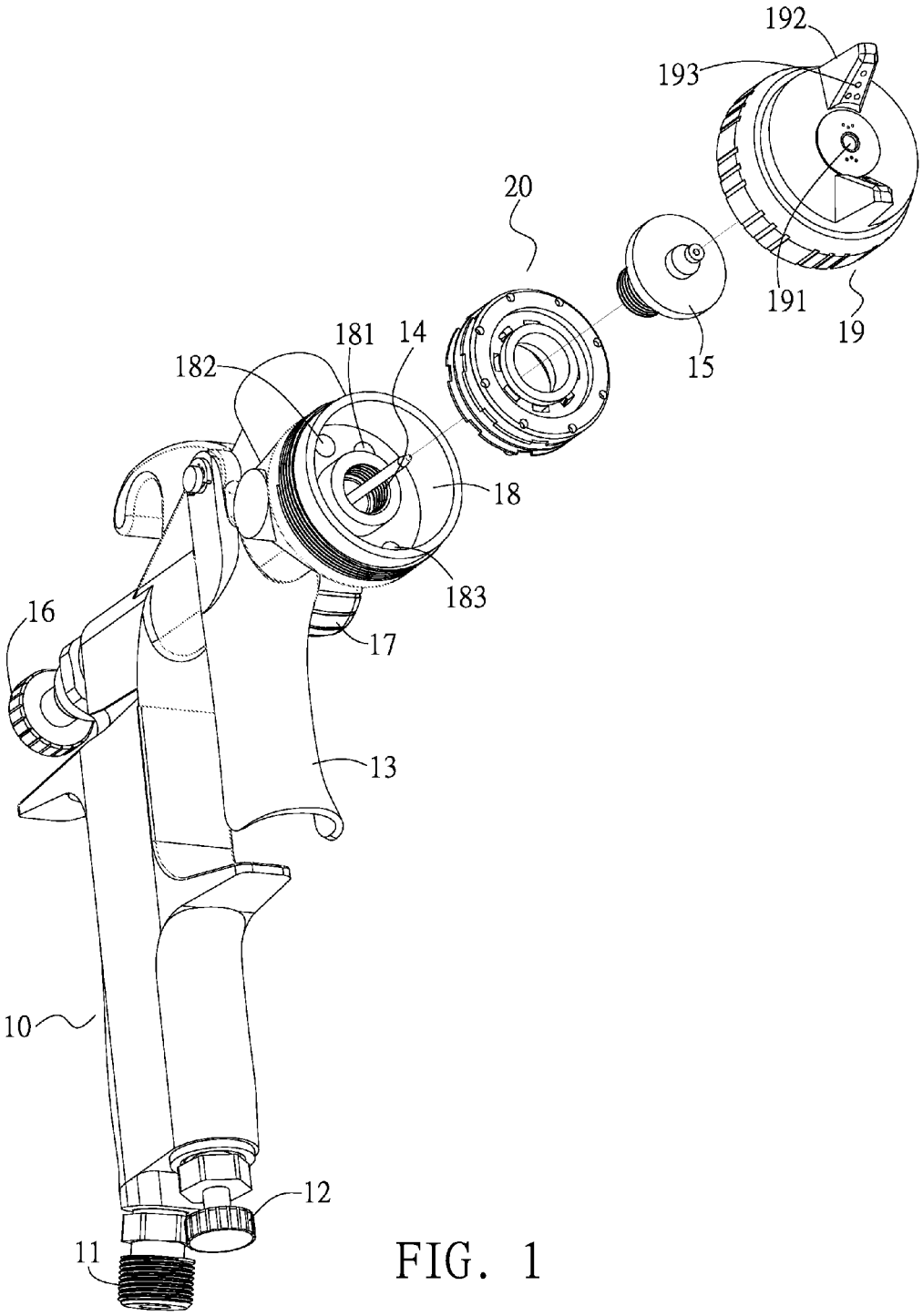
FIG. 1 is the drawing of the local structure of the preferred embodiment of the present invention

DETAILED DESCRIPTION OF THE ELEMENTS (1) Inlet
(2) Outlet
(10) Spray-gun main body
(11) Connector
(12) Inlet knob
(13) Pressing handle
(14) Trigger
(15) Nozzle
(16) Control knob
(17) Adjustment knob
(18) Spray-gun head cavity
(181) Spraying paint air hole
(182) Atomizing air hole
(183) Positioning hole
(19) Nozzle
(191) Air Outlet
(192) Flank section
(193) Atomizing hole
(20) Diverting housing
(21) Inner housing
(211) Passing hole
(212) Isolation ring
(213) Protruding pillar
(214) Guiding stream gap hole
(215) Airflow circulating tank
(216) Inlet tank
(217) Outlet tank
(218) Positioning hole
(22) Outer housing
(221) Passing hole
(222) Protruding pillar
(223) Isolation ring
(224) Circular tank
(225) Guiding stream air hole
(226) Airflow circulating tank
(227) Inlet tank
(228) Outlet hole

DESCRIPTION OF THE PREFERRED EMBODIMENT

Figure 2:
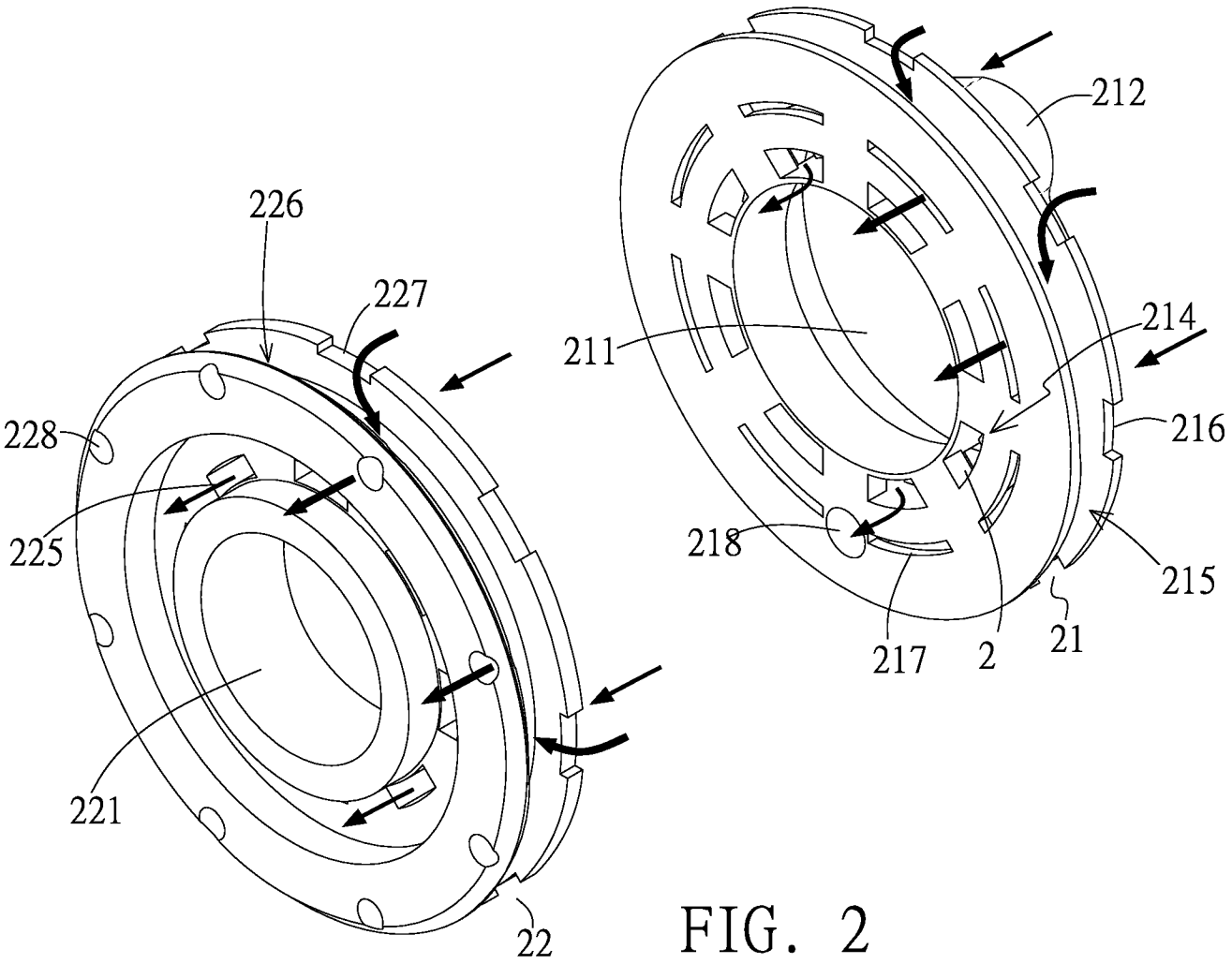
FIG. 2 is the drawing of the structure of diverting housing of the preferred embodiment of the present invention before assembly
Figure 3:
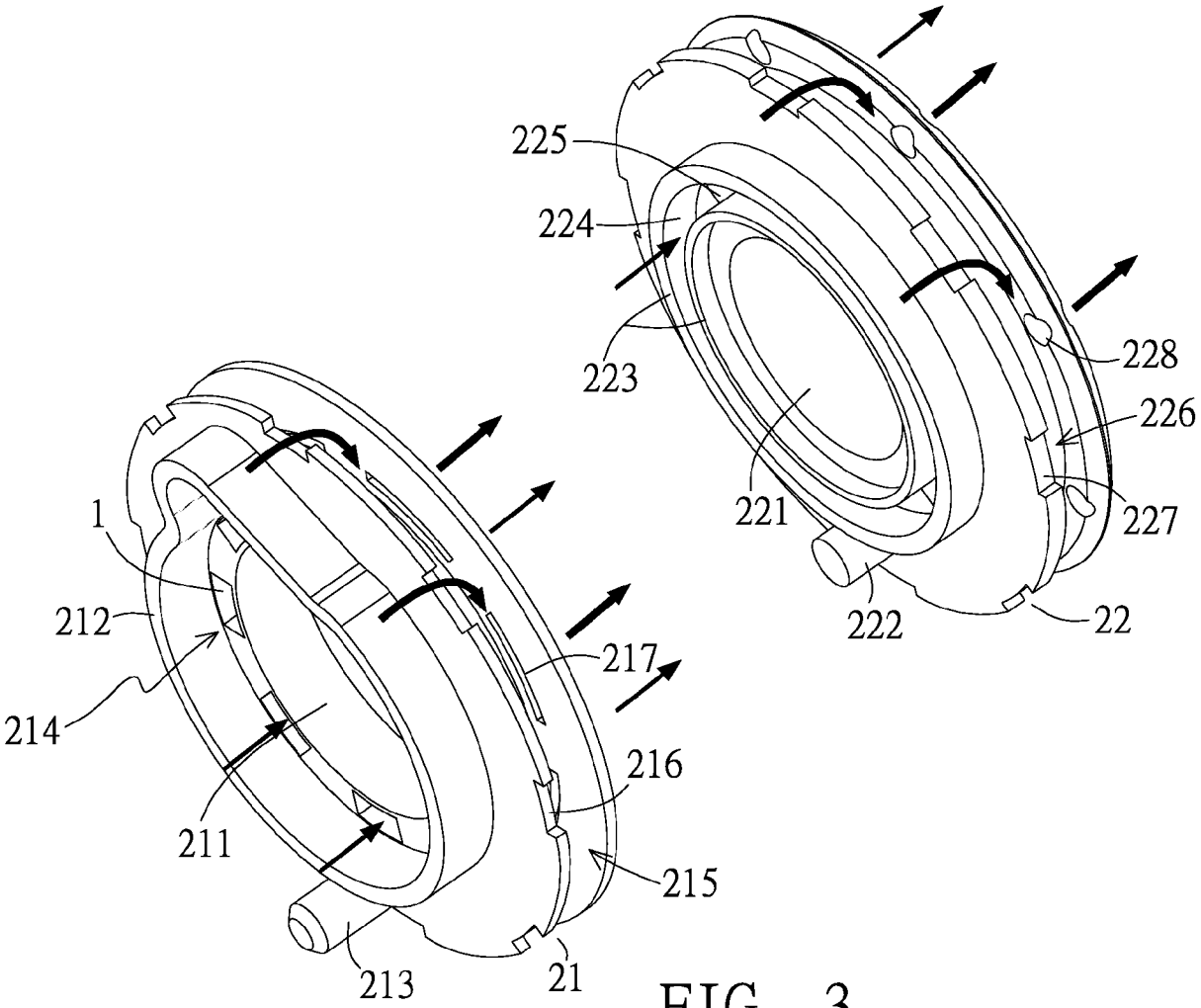
FIG. 3 is another view of diverting housing of the preferred embodiment of the present invention before assembly
Figure 4:
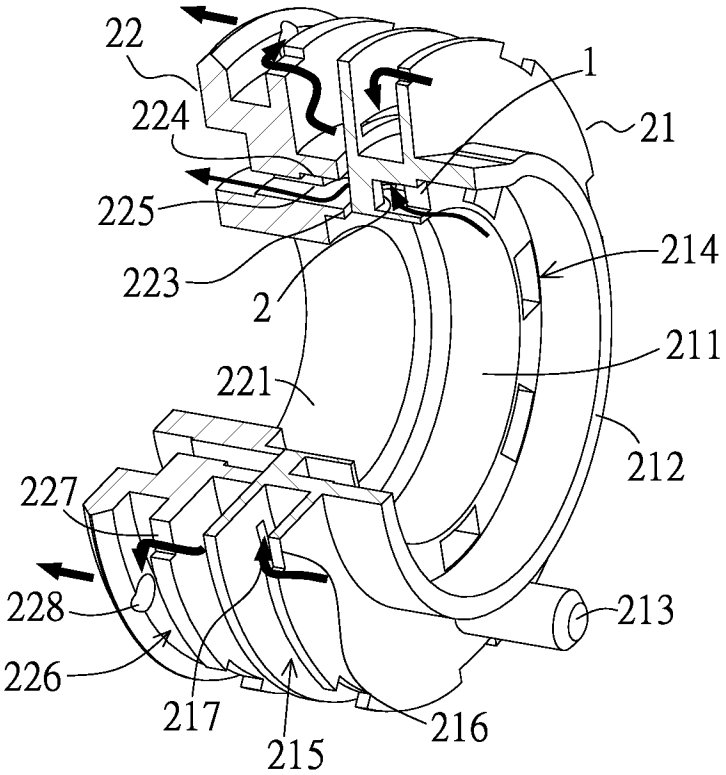
FIG. 4 is the drawing of assembly of diverting housing of the preferred embodiment of the present invention
Figure 5:
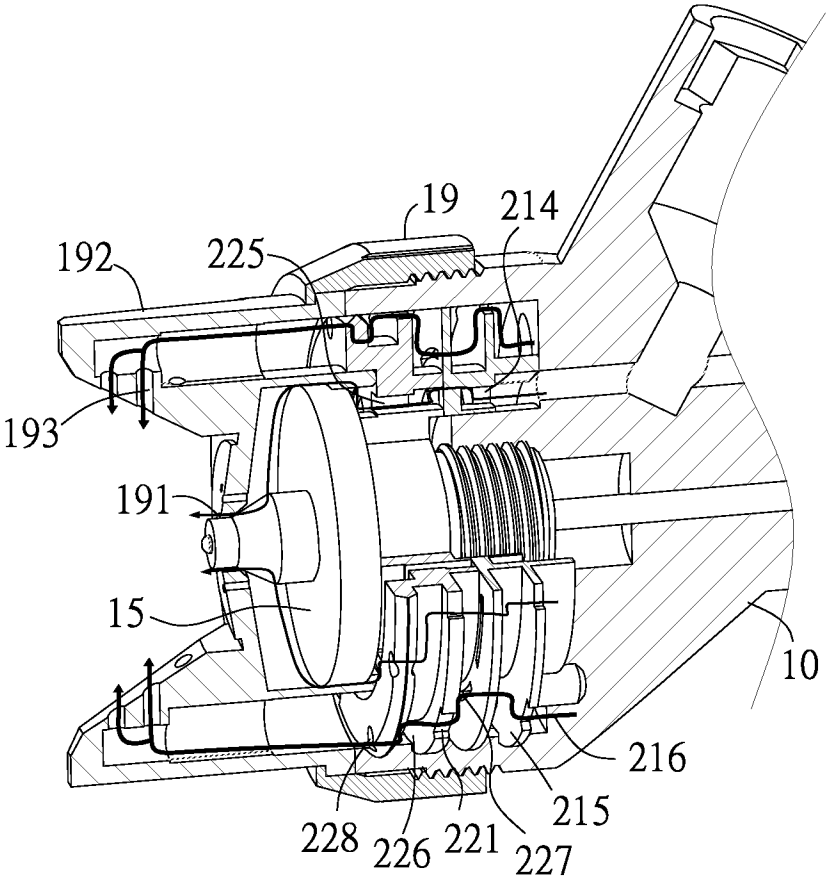
FIG. 5 is the structural relationship of the flowing state of airflow of the preferred embodiment of the present invention

Regarding the structural constituents, technical means, and functions achieved of the present invention, please refer to the drawings for further descriptions of the embodiment of the present invention:

FIG. 1 is the drawing of the local structure of the present invention. The drawings of the structure of FIGS. 2 and 3 and the drawings of structural relationship of FIGS. 4 and 5 are the preferred embodiment of the present invention. As Shown in the drawings, the structural design of the present invention is mainly in a spray-gun main body (10) suitable for holding in hand, where in the lower end of the spray-gun main body (10) is installed with a connector (11) for connecting to a unit of an air compression device, and the side is installed with an inlet knob (12) for adjusting the volume of inlet air. Together with the pressing handle (13) installed at the cavity section of the upper end of the handle section, the trigger (14) crossly installed at the cavity section of the main body (10) is used for the control to open the nozzle (15) at the front end. And with the controlling knob (16) at the back end of the cavity section of the main body (10), the controlling force and opening amplitude can be adjusted. Again, at the end of the cavity section or on the other side of the spray-gun main body (10) another adjustment knob (17) is installed for control of diverting volume of spraying paint airflow and atomization airflow guided by the internally planned main channel (not shown) and secondary channel (not shown) in order to adjust the air volume spit out from spraying paint air hole (181) and atomizing air hole (182) from the of spray-gun head cavity (18). And again the action of partitioned guiding airflow of the diverting housing (20) internally installed in the spray-gun head cavity (18), the airflow blown out respectively from the air outlet (191) of the center of the spray-gun housing (19) and the spitting hole (193) installed protruding from the flank section (192) on both sides to achieve its control function of atomized spraying paint, constitute the basic functional structure of the spray-gun of the present invention;

Wherein the diverting housing (20) is a composite form of an inner housing (21) and an outer housing (22), and the outer diameter of the inner housing (21) and outer housing (22) are in closely matched state with the inner diameter of the cavity (18) of the spray-gun head, and the passing holes (211)(221) are installed respectively in the center of the inner and outer housing (21)(22) in order for the front end of the trigger (14) to pass through the nozzle (15) slotting unit. The inside face of inner housing (21) forms an isolation ring (212) that covers the spraying paint air hole (181) and on one side of the location a protruding pillar (213) is installed to catch the positioning hole (183) for installation on the spray-gun head cavity (18) so that when the inner housing (21) is inserted into the spray-gun head cavity (18) and the protruding pillar (213) is clicked on the positioning hole (183), the previously stated isolation ring (212) is used to isolate the spraying paint air hole (181) and atomizing air hole (182). Within the inner radius of the isolation ring (212) a reserved number of guiding airflow gap holes (214) are installed, and the inlet (1) and outlet (2) of the guiding airflow gap holes (214) are presenting a non-penetrating crossly located guiding style. And the outer peripheral edge of the inner housing (21) forms an airflow circulating tank (215), therein the peripheral edge of the inside plate of the airflow circulating tank (215), using partitioned style, is installed with reserved number of inlet tanks (216), and the outside plate of the airflow circulating tank (215), which is from the tank bottom cross positioned into the inlet tank (216), is installed with a reserved number of outlet gap holes (217), and again at the outside of the inner housing (21) is installed with a positioning hole (218) for the protruding pillar (222) on the outside of the outer housing (22) to be inserted in order to obtain a flip connecting position. The inside face of the outer housing (22) forms a pair of dual isolation rings (223), wherein the circular tanks (224) of the isolation rings (223) are installed with a reserved number of guiding airflow air holes (225) and when the outer housing (22) covers on the outside of the inner housing (21), the guiding airflow air holes (225) are presenting a cross away relationship with the outlet (2) of the guiding airflow air holes (214) of inner housing (21). And the outside peripheral edge of the outer housing (22) also forms an airflow circulating tank (226) wherein the inner plate peripheral edge of the airflow circulating tank (226) is installed in a partitioned style with a reserved number of inlet tanks (227), and the outside plate of the airflow circulating tank (225) in a cross position, is penetratingly installed with a reserved number of air outlet holes (228). Based on the non-penetrating crossly style planned guiding gas channel of the spraying paint airflow and atomization airflow from the guiding airflow gap holes (214) and guiding airflow holes (225) of the inner and outer housing (21) (22), and the spraying paint airflow and atomization airflow consisting respectively of the inlet tank (216), outlet gap hole (216), inlet tank (227), and outlet hole (228), when the spraying paint airflow and atomization airflow of the spray-gun are passing through the diverting housing (20) installed inside the spray-gun cavity (18), it will present in circulating style and extend its staying time and with this forming a diverting even pressure effect, so that the outlet air is more even and avoiding the occurrence of an unstable wind phenomena Through the above described composite diverting housing (20) formed by covering inner housing (21) and outer housing (22), as the outer diameter and the inner diameter of the spray-gun head cavity (18) is presented in a closely matching relationship, the airflow will pass through the channel formed by the guiding gas channel installed by the diverting housing (20). In other words, as the spraying paint airflow is guided to flow out through the spraying paint air hole (18) of the spray-gun head cavity (18), it is isolated by the isolation ring (212) of the inner housing (21) to enable it to pass only from the inlet (1) of the guiding airflow gap hole (212) through the cross positioned outlet (2) of the guiding stream gap hole (225) and guided to the guiding stream air hole (225) of the outer housing (212) and finally spit out from the residual gap between the air outlet (191) of the spray-gun housing (19) and the nozzle (15) and brings out the paint of the nozzle (15) by matching with the suction action. And after the atomization airflow is guided out from the atomizing hole (182) of the spray-gun head cavity (18), due to the partition of isolation ring (212), it is guided into the inlet tank (216) of the airflow circulating tank (215) of the inner housing (21), and again guided to the outer housing (22) from the outlet air gap hole (217) of the outside plate of airflow circulating tank (215), then guided from the inlet tank (227) of the inside plate of the airflow circulating tank (226) of the outer housing (22), then guided out to the outlet air outlet (228) of airflow circulating tank (226), and finally spit out from the atomizing hole (193) of the flank sections (192) on the two sides of spray-gun housing (19), achieving the atomizing function of spraying paint. And in the process of spitting out of spraying airflow and atomization airflow, due to the restriction of inner and outer housing (21) (22) of the diverting housing (20) presenting the circulating style of the planned guiding gas channel, the airflow will not spit out directly, enabling it to generate an even pressure result during the process of circulating flow. Therefore the outlet air is able to sustain stability and further achieves the result of even output air, effectively improving its paint spraying quality;

In summary, the present invention in order to enable the paint spray-gun with more even and stable operation so as to promote paint spraying quality, particularly uses the structural innovation to design diverting housing through partitioning spraying paint airflow and atomization airflow within the spray-gun head cavity in order to achieve the objective of diverting, and further uses the airflow to present circulating flow and achieve the result of even pressure and improving the problem of unstable air flow of conventional design, making the spraying paint atomizing result more even and enabling the drastic improvement and sustaining in spraying paint quality. As a whole, the invention indeed is extremely good to use in the industry and with practical value. We hereby propose to file the present patent application.

The invention claimed is:

1. A paint spray-gun even-pressure diverting housing structure, comprising:

a hand-holding spray-gun main body having a guiding airflow and diverting channels inside, on a lower side of a handle of the main body having a connector for connecting to an air compression device, an air inlet knob installed on a side for controlling inlet air volume to match with the pressing handle installed at a cavity section at the upper end of the handle section for the control of the opening of a nozzle at the front of a trigger cross-installed at the back of the cavity section of the main body;

an adjustment knob installed in a reserved location in the cavity section of the main body to control an interior of the spray-gun main body designed for guiding a diverting volume of spraying paint airflow and atomization airflow passing through different airflow channels to vary the air volume spit from a spraying paint air hole of the spray-gun head cavity and from the atomization airflow, wherein in the action of isolation of guiding airflow installed in the diverting housing in the spray-gun head cavity the airflow is blown out from an air outlet at the center of the spray-gun housing and a lateral air spitting hole installed at a protruding flank section on both sides in order to achieve the control function of spreading paint;

an inner housing and an outer housing having the outer diameters of the inner and outer housing very similar to the inner diameter of the spray-gun head cavity, a plurality of holes installed at the center of the inner and outer housings respectively for a nozzle slotting unit of the trigger to pass through, wherein the inner side of the inner housing forms an isolation ring to cover the spraying paint air hole and differentiate an atomizing hole;

a plurality of non-penetrating guiding stream gap holes located at the inner diameter of isolation ring, a pair of dual isolation rings formed by the inner side of the outer housing wherein the inside of the isolation rings has a plurality of guiding stream air holes installed and the guiding stream air holes form an intersecting relationship with guiding stream gap holes of the inner housing, and this guiding gas channel of non-penetrating spraying paint airflow, wherein the outer peripheral edge of the inner and outer housing forms a respective airflow circulating tank;

a plurality of inlet tanks using partitioned style installed at the peripheral edge of an inner side plate of the airflow circulating tank of the inner housing, wherein an outer side plate of the inner housing's airflow circulating tank, which is cross positioned from the tank bottom inlet, is installed with a reserved number of outlet gas holes; wherein the inlet tanks, which are partitioned style, are installed at the peripheral edge of the inner side plate of the air circulating tank of the outer housing, and a plurality of outlet gas holes located at a cross inserted position of the inlet tank of the outer side plate of the airflow circulating tank, wherein through the guiding gas channel of non-penetrating atomization airflow, the planned non-penetrating guiding gas channel of spraying paint airflow and atomization airflow, the spraying paint airflow of the spray-gun and atomization airflow when passing through the diverting housing installed inside the spray-gun head cavity will form flow in circulating style and extend its staying time and form a diverting even pressure effect and enable the spraying paint to more evenly spread.

2. The paint spray-gun even-pressure diverting housing structure of claim 1, the inlet and outlet of the guiding stream air hole installed in the internal peripheral of its isolating ring of the inner housing has a non-penetrating crossly located guiding style.

* * * * *